United States Patent [19]

Brunn

[11] Patent Number: 4,644,222

[45] Date of Patent: Feb. 17, 1987

[54] COLOR PICTURE TUBE WITH MOUNTING STRUCTURE FOR A SHADOW MASK

[75] Inventor: Otto Brunn, Wernau, Fed. Rep. of Germany

[73] Assignee: Standard Elektrik Lorenz AG, Stuttgart, Fed. Rep. of Germany

[21] Appl. No.: 716,449

[22] Filed: Mar. 27, 1985

[30] Foreign Application Priority Data

Mar. 28, 1984 [DE] Fed. Rep. of Germany ..... 3411330

[51] Int. Cl.[4] ..... H01J 29/07

[52] U.S. Cl. ..... 313/406; 313/402

[58] Field of Search ..... 313/404, 406, 407, 402

[56] References Cited

U.S. PATENT DOCUMENTS 2,922,063 1/1960 Haas ..... 313/406

FOREIGN PATENT DOCUMENTS 2097996 11/1982 United Kingdom ..... 313/402

*Primary Examiner*—Palmer C. DeMeo

*Attorney, Agent, or Firm*—Donald J. Lenkszus

[57] ABSTRACT

In a color picture tube, the shadow mask is suspended in a way such that the pins inserted into the rim portion of the faceplate are aligned vertically in relation to the axis of symmetry of the color picture tube. The free ends of the pins are of spherical design, and comprise a conical part. Two-piece, trapezoidal hold members for the shadow mask rest on the pins. Each of the hold members is resiliently pressed upon the pins by a locking spring.

10 Claims, 8 Drawing Figures

COLOR PICTURE TUBE WITH MOUNTING STRUCTURE FOR A SHADOW MASK

BACKGROUND OF THE INVENTION

This invention pertains to a color picture tube.

In particular, the invention pertains to a color picture tube of the type having a shadow mask mounted in the proximity of the faceplate by means of pins which are disposed in the corners of the faceplate which with hole containing supports on the shadow mask. The supports are retained at the pins with the aid of locking springs.

German Pat. No. 31 25 095 teaches a color picture tube in which the pins for supporting the mask are fused into the rim portion of the faceplate at such an angle that their longitudinal axes extend parallel in relation to the electron beam deflected toward the respective corner. The free ends of the pins are of conical design, and the hold members are oblong and of one piece. Two part clamping members are used for locking the hold members on the pins.

SUMMARY OF THE INVENTION

One object of the invention is to provide a color picture tube having a holding arrangement for its mask which permits easy insertion and removal of the mask during the manufacture of the color picture tube and which, in the event of forces acting thereupon from the outside, does not exert any unbuttoning forces.

In accordance with the principles of the invention a color picture tube which has a frameless shadow mask is suspended in such a way that the pins inserted into the rim portion of the faceplate are aligned vertically in relation to the axis of symmetry of the color picture tube. The free ends of the pins are of spherical design and comprise a conical part. Two-piece trapezoidal hold members for the shadow mark rest on the pins. Each of the hold members is resiliently pressed upon the pins by a locking spring.

BRIEF DESCRIPTION OF THE DRAWING

The invention will be better understood from a reading of the following detailed description in conjunction with the drawings in which.

DETAILED DESCRIPTION

Figure 1:
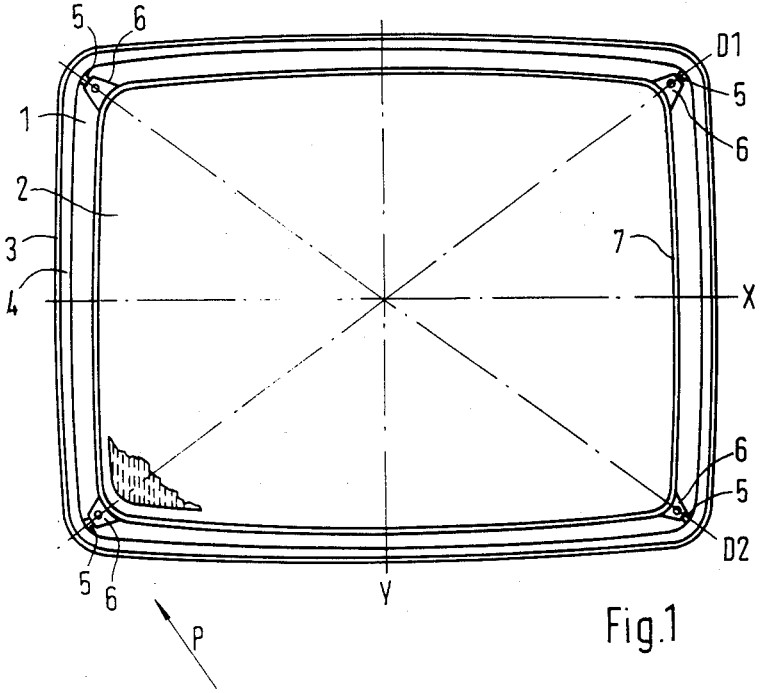
FIG. 1 is a top view on to a faceplate of a picture tube with an inserted mask.

FIG. 1 shows a faceplate 1 with an inserted mask 2 of a conventional type of color picture tube.

For reference purposes, FIG. 1 shows an X axis, a Y axis and diagonals D1, D2. The frit surface on the rim portion 4 of the faceplate 1 is indicated by the reference numeral 3. The faceplate 1 carries a phosphor layer on its inside. At the point of intersection of the diagonals D1 and D2 with the rim portion 4 of the faceplate 1, pins 5 are provided which, via hold members 6, carry the mask. The hold members 6 engage on the rim portion 7 of the mask 2.

The axis of symmetry of the color picture tube, in the point of intersection of the X axis with the Y axis, is vertically on the drawing plane. The hold members for the mask may alternatively be provided at the intersection of the X and the Y axes with rim portion 7 of mask 2 and rim portion 4 of faceplate 1.

Figure 2:
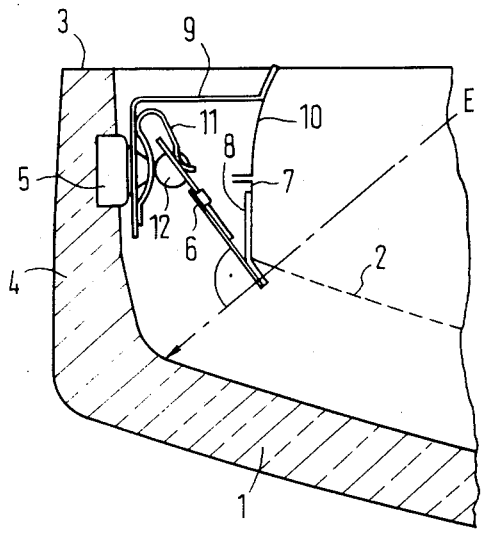
FIG. 2 is a side view in the direction as indicated in FIG. 1 of a hold member for supporting the mask in one corner of the faceplate.

As seen in FIG. 2, pin 5 has one end fused into the rim portion 4 of the faceplate 1. Pin 5 is inserted into the rim portion 4 as to be vertical relative to the tube axis. The free end of pin 5 carries two-part hold member 6 which, via corner reinforcement 8, is connected to the outside of rim portion 7 of the mask 2. The hold member 6 is so aligned to extend perpendicular relative to electron beam E as deflected into this corner. Moreover, the pin 5 carries a support angle 9. The magnetic shielding 10 of the color picture tube is mounted to the end of support angle 9. At the end of support angle 9 abutting on pin 5, an almost V-shapedly bent locking spring 11 is mounted. The free end of the spring presses the support member 6 resiliently upon the pin 5.

Figure 3:
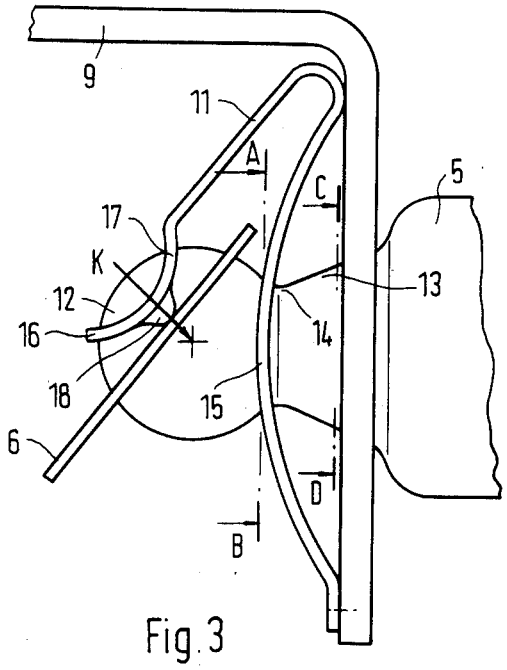
FIG. 3 is an enlarged view of the hold member of FIG. 2.

As most clearly shown in FIG. 3, pin 5 has a conical part 13 which carries the spherical end 12. The diameter of the spherical end 12 is larger than the smallest diameter of the conical part 13, so that a constriction 14 exists between the conical part 13 and the spherical end 12. Support member 6 rests on the spherical end 12. The support angle 9 is placed onto the conical part 13 of the pin 5. Locking spring 11 extends in a bend to contact a point of support angle 9 lying above the conical part 13, and is secured to that end of the support angle 9 which as shown in FIG. 3 points downward. The apex of the bend of locking spring 11 abuts on the portion of the spherical end 12 pointing toward the constriction 14, and thus presses the support angle 9 on to the conical part 13. Somewhat behind the point where the locking spring touches the support angle 9, the spring is bent off in such a way that its free end 16 presses upon the hold member 6. This prevents hold member 6 from slipping off the spherical end 12 of pin 5. The free end 16 of the locking spring 11 ends in a bend 17 pointing toward the hold member 6. In the apex of bend 17, bulgings 18 are provided for, so that only small bearing surfaces result. The forces exerted by the locking spring 11 via the bulgings 18 upon the hold member 6 extend in the direction indicated by arrow K, toward the center point of the spherical end 12 of the pin 5.

Figure 4:
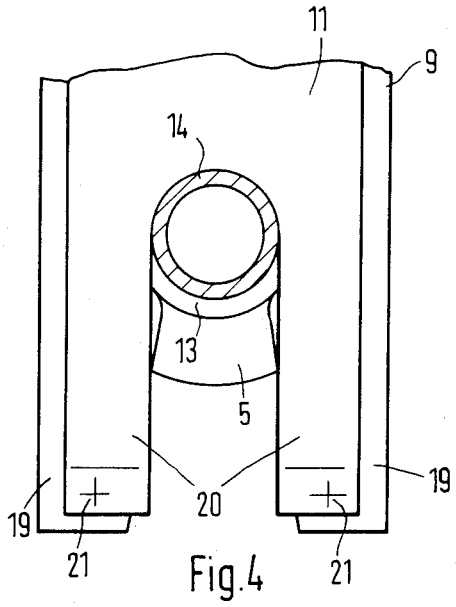
FIG. 4 is a section taken on line A-B of FIG. 3.

The sectional view of FIG. 4 taken along the line A-B of FIG. 3, shows the parts of the support angle 9 and locking spring 11 resting on pin 5. The support angle 9 and locking spring 11 are both provided with a central incision, so that they both end in two prongs 19 and 20, respectively. These prongs 19 and 20, for example, are joined to one another by weld spots 21. The width of the incision in the locking spring 11 is chosen to be larger than the diameter of the constriction 14, but smaller than the diameter of the spherical end of the pin 5. The width of the incision in the support angle 9 is chosen to be larger than the diameter of the constriction 14, but smaller than the larger diameter of the conical part 13. Therefore, the support angle with the locking spring can be placed from above on to the conical part 13 of the pin 5. The support angle 9 is thereafter pressed against the enlarging end of the conical part 13 and is secured in this position by bent portion 15 of locking spring 11 abutting on the spherical end 12.

The inwardly bent portion 17 of the locking spring 11 is likewise provided with an incision extending in the center so that locking spring 11 ends in two prongs which press symmetrically upon hold member 6.

Figure 5:
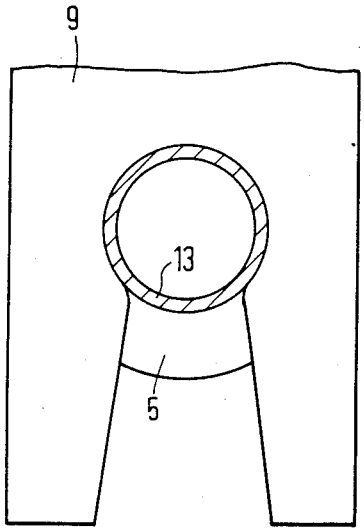
FIG. 5 is a section taken on line C-D of FIG. 3.

In FIG. 5, the incision or notch in the support angle 9 is clearly shown. At the rim portion of the support angle, the incision is larger than further toward the inside, and it ends up in a circular cutout. Support angle 9 thereby embraces the conical part 13 of the pin 5 throughout a large part of the circumference. Thus, support angle 9 is secured in its final position and prevented from being pulled off in the upward direction.

Figure 6:
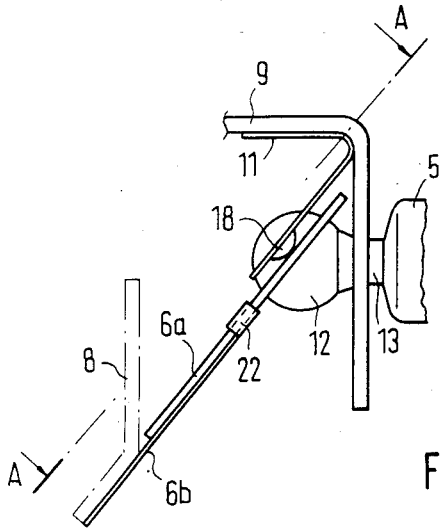
FIG. 6 is a side view of a second embodiment of the hold member.

FIG. 6 is a side view of a second embodiment of the hold member. Conical part 13 extends in a direction opposite to that of the hitherto described pin. The thinner end of the conical part 13 points toward the fused end of the pin 5. The locking spring 11 is now V-shaped and mounted with its one end to the horizontally extending portion of the support angle 9. The other end of the locking spring again ends up in two prings, each of which is provided with a bulge 18. Bulges 18 press resiliently against the hold member 6. The pressing force is directed toward the center of the spherical end 12. By mounting the locking spring to the horizontal part of the support angle 9, the angle is pulled on the conical part 13 against the spherical end 12.

The holder includes parts 6*a* and 6*b*. Part 6*a* of the hold member engages the spherical end of the pin 5. Part 6*b* of the hold member carries the corner reinforcement of the mask 2. Part 6*a* is of a somewhat thicker design and rigid, whereas part 6*b* has resilient properties. On the part 6*b*, flaps 22 are provided for, which capture and engage part 6*a*. In addition, thereto, the parts 6*a* and 6*b* are joined to one another by spot welding.

Figure 7:
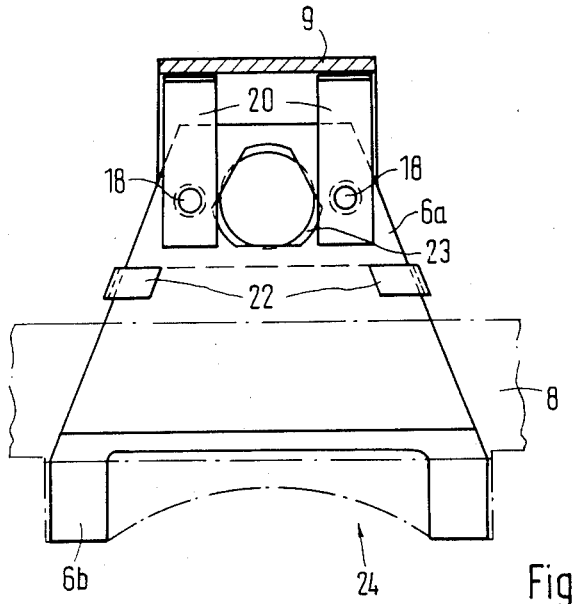
FIG. 7 is a section taken along line A—A of FIG. 6.

FIG. 7 is a sectional view taken along the line A—A of FIG. 6. From this it can be seen that hold member 6 has a trapezoidal shape; the one end points toward the pin 5, and the base side points toward the corner reinforcement (fillet) 8. The upper piece of the hold member is formed by part 6*a* and the lower piece is formed by the part 6*b*. A triangular hole 23 is provided in the proximity of the upper rim portion of the part 6*a*. Due to its triangular form, hole 23 engages spherical end 12 of the pin 5 at three points. Corner reinforcement 8 which carried the mask 2 is mounted on the lower resilient part 6*b*. A recess 24 is provided in both part 6*b* and on the associated part of the corner reinforcement 8 thus preventing the electron beam from being shadowed during its deflection into the respective corner.

Figure 8:
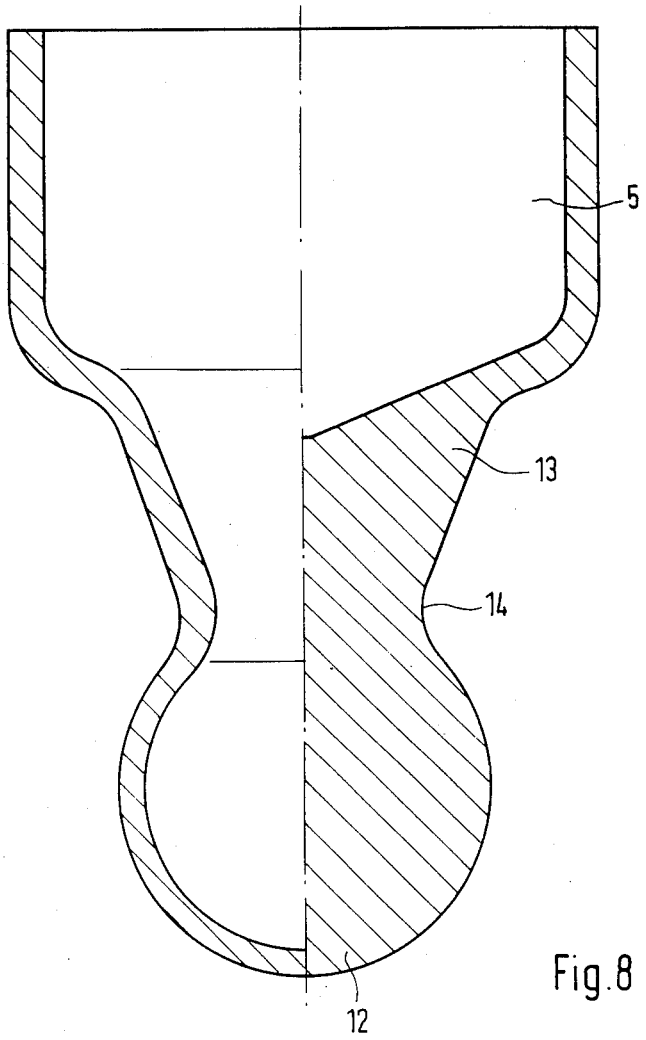
FIG. 8 is a section taken through a pin.

FIG. 8 is a sectional view taken through a pin 5. On the right side of the line of symmetry there is shown a pin which was either turned from a rod length of circular cross section, or extrusion moulded. On the left of the line of symmetry there is shown a pin shaped from a sheet metal part. All pins 5 are rotation-symmetrical and have a spherical end 12. Between the end as fused in the glass of the faceplate 1, and the spherical end 12, there is provided a conical part 13 and, in the first embodiment of the hold member, a constriction 14. Relative thereto, the thinner end of the conical part 13 points toward the spherical end 12. In the pin 5 of the second embodiment of the hold member, the thinner end of the conical part 13 points toward the end of the pin 5 which is fused (sealed) in the glass of the faceplate.

As a particular advantage relating to the hitherto described arrangement for holding the mask in position inside the color picture tube is that angular variations between the pin (5) and the hold member (6) will have no influence upon the quality of the mask seating.

In some types of color picture tubes there is no room for the hold member between the mask and the rim portion of the faceplate. In these cases, the mask may be provided with a corner reinforcement (fillet) lying within, with the hold member being secured thereto.

What is claimed is:

1. A color picture tube comprising:

a faceplate;

a shadow mask including a rim portion;

a magnetic shield adjacent said rim portion;

a plurality of mounting structures for mounting said shadow mask in proximity to said faceplate, each of said plurality of mounting structures comprising:

a support pin having one end portion fused in said faceplate, an intermediate portion which is generally conical in shape, and a generally spherical other end portion;

a support angle having a first and a second end wherein said first end is attached to said magnetic shield and said second end is carried by said support pin;

a generally trapezoidal shaped, flat hold member attached to said rim portion of said shadow mask, said flat hold member having its narrow end pointing toward said support pin and having a hole in said narrow end adapted to receive said support pin;

a "V"-shaped locking spring having one end mounted on said support angle and abutting said intermediate portion and having its other end pressing said hold member toward the center of said spherical shaped other end portion; and wherein the longitudinal axis of said support pin is perpendicular to the axis of symmetry of said picture tube.

2. A color picture tube in accordance with claim 1, wherein:

each said pin comprises a constriction between said intermediate portion and said other end portion.

3. A color picture tube in accordance with claim 1, wherein:

each said pin is symmetrical above its longitudinal axis.

4. A color picture tube in accordance with claim 1, wherein:

each said pin is formed from sheet metal.

5. A color picture tube in accordance with claim 1, wherein:

each said pin is of solid construction.

6. A color picture tube in accordance with claim 1, wherein:

each said hold member comprises first and second overlaying parts, said first part having flaps on its sides which fold over and embrace said second part.

7. A color picture tube in accordance with claim 1, wherein:

said hole is triangular with a diameter smaller than the diameter of said spherical shaped other end portion.

8. A color picture tube in accordance with claim 1, wherein:

said other end of said spring comprises two prongs.

9. A color picture tube in accordance with claim 8 wherein:

each of said prongs includes a bent portion for engaging said hold member.

10. A color picture tube in accordance with claim 8, comprising:

a bulge on each of said prongs, each said bulge engaging said hold member.

* * * * *